US006874656B2

(12) United States Patent
Rohr et al.

(10) Patent No.: US 6,874,656 B2
(45) Date of Patent: Apr. 5, 2005

(54) VENTED CLOSURE

(75) Inventors: Robert D. Rohr, LaOtto, IN (US); Jay E. Witte, Decatur, IN (US)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 10/453,968

(22) Filed: Jun. 4, 2003

(65) Prior Publication Data

US 2004/0245260 A1 Dec. 9, 2004

(51) Int. Cl.[7] ..... G01F 11/00
(52) U.S. Cl. ..... 222/1; 222/153.06; 222/481.5; 222/494
(58) Field of Search ..... 222/1, 153.06, 222/481.5, 490, 491, 494

(56) References Cited

U.S. PATENT DOCUMENTS

| | | | | | |
|---|---|---|---|---|---|
| 4,513,784 | A | | 4/1985 | Farrand et al. | 137/854 |
| 4,513,891 | A | * | 4/1985 | Hain et al. | 222/213 |
| 5,086,950 | A | | 2/1992 | Crossdale et al. | 222/88 |
| 5,110,013 | A | | 5/1992 | Clark et al. | 222/382 |
| 5,240,149 | A | * | 8/1993 | Schmidt | 222/212 |
| 5,320,253 | A | * | 6/1994 | Robinson | 222/175 |
| 5,320,254 | A | * | 6/1994 | Ranalletta et al. | 222/189.08 |
| 5,348,046 | A | | 9/1994 | Kozumplik, Jr. et al. | 137/454.4 |
| 5,507,318 | A | | 4/1996 | Israelson | 137/854 |
| 5,588,562 | A | * | 12/1996 | Sander et al. | 222/153.06 |
| 5,819,823 | A | | 10/1998 | Brändström | 131/311 A |
| 5,896,898 | A | | 4/1999 | Crossdale et al. | 141/83 |
| 5,908,143 | A | | 6/1999 | Crossdale et al. | 222/52 |
| 5,944,211 | A | | 8/1999 | Woodnorth et al. | 220/203.13 |
| 6,062,248 | A | | 5/2000 | Boelkins | 137/118.02 |
| 6,073,809 | A | * | 6/2000 | Long, Jr. | 222/153.06 |
| 6,095,370 | A | | 8/2000 | Rhine et al. | 222/1 |
| 6,109,480 | A | | 8/2000 | Monsrud et al. | 222/83 |
| 6,142,750 | A | | 11/2000 | Benecke | 417/411 |
| 6,152,327 | A | | 11/2000 | Rhine et al. | 222/88 |
| 6,206,058 | B1 | | 3/2001 | Nagel et al. | 141/302 |
| 6,328,543 | B1 | | 12/2001 | Benecke | 417/411 |
| 2002/0005415 | A1 | * | 1/2002 | De Laforcade | 222/212 |

* cited by examiner

*Primary Examiner*—Joseph A. Kaufman
(74) *Attorney, Agent, or Firm*—Woodard, Emhardt, Moriarty, McNett & Henry LLP

(57) ABSTRACT

A vented closure for closing and venting a container with threaded engagement to a neck portion of the container for dispensing fluid from the container includes a unitary, molded plastic cap constructed and arranged for threaded engagement to the container. The threaded cap defines a septum orifice that is sized and arranged to receive a siphon tube. A gasket is assembled into the threaded cap for sealing the interfit between the vented closure and the container. An elastomeric venting valve is assembled into the threaded cap and the venting valve includes a septum with a slit therein for receiving in a self-sealing manner the siphon tube. A retainer ring is used to capture the venting valve within the threaded cap and a safety ring in unitary combination with the threaded cap retains the vented closure on the container.

18 Claims, 4 Drawing Sheets

VENTED CLOSURE

BACKGROUND OF THE INVENTION

The present invention relates in general to container closures that are constructed and arranged to threadedly attach to a container opening. More specifically, the present invention relates to a container closure that is vented to allow the entry of air into the container (to relieve a negative pressure) as some of the liquid contents of the container are removed by way of an exit port. This particular closure structure can be described as a double vent closure. While the intended contents of the container are primarily liquids, slurried products can also be dispensed, as will be described herein.

The present invention may find applicability in a variety of structural configurations and equipment, but the present invention is described in the context of an apparatus for dispensing a concentrated chemical in liquid form or a slurried product, such as those used for industrial cleaning processes. Additionally, the present invention is described in the context of a replaceable, sealed container that is intended to be flow coupled to a machine, such as an automatic dishwashing machine, for the delivery of a washing detergent to the machine.

U.S. Pat. No. 5,086,950 issued Feb. 11, 1992 to Crossdale et al. discloses a "liquid dispensing apparatus" that is described as an apparatus for dispensing liquid or slurried products for industrial cleaning processes. Since the present invention has a similar focus and applicability, though structurally different, U.S. Pat. No. 5,086,950 is incorporated by reference herein for its background discussion and its overall system environment explanation. The '950 patent describes the Background of the Invention in the following manner.

Conventionally, liquid detergents are supplied to customers in large drums and the detergent reservoir in the dishwashing machine is regularly filled up from the drums. This is a laborious and inconvenient method of keeping the dishwashing machine topped up and could result in spillage of the liquid, which is often caustic, onto the operator's hands.

Alternatively, the detergent may be supplied from a relatively large drum and pumped into the dishwashing machine along a tube or otherwise dispensed directly into the dishwashing machine. Such pumping systems often cause spillage of the detergents when the operator is disconnecting the reconnecting the pumping system to the supply drum.

An aim of one aspect of the present invention is to provide a system whereby the liquid product can be supplied in relatively small containers which are fitted directly to the operative part of a machine, for example the dispenser of a dishwashing machine, thereby minimizing or eliminating spilling and leakage. An aim of a further aspect of the invention is to provide a system whereby the liquid product can be easily and cleanly dispensed along a tube, again minimizing or eliminating spillage and soiling of the user's hands.

The present invention provides a novel and unobvious advance in the state of the art and an improvement over the closure described in the '950 patent. While the intended use for the present invention is part of a fluid dispensing system, it should be noted that the container to which the closure is attached can be fitted directly to the machine in an inverted orientation or used upright and connected by a conduit to the machine. The latter arrangement requires some type of pumping or suction structure in order to draw out fluid for delivery to the machine. In either configuration, a fluid delivery conduit or siphon tube is utilized. Since the container is sealed, a vacuum is created as the fluid contents are removed and the container must then be vented in order to relieve the interior negative pressure. This is part of the present invention. Ultimately, the liquid or slurry product in the container is able to be dispensed in a smooth flowing manner, without spillage or soilage of the hands of the user.

The vented closure, according to the present invention, functions as a self-contained, tamper-proof screw cap that is utilized after the container is filled with the selected fluid or slurry product. Included as part of the vented closure is a central diaphragm or septum with a precision slit and a guide ring portion as part of the cap for receiving and guiding a suction or siphon tube and including a pressure balanced vent valve. The proper functioning of the overall closure system including the vented closure and the container cooperate to secure the liquids and/or slurry products within the container from spillage, leakage, unauthorized access, and container paneling/collapse. All of this is accomplished with a consistent rate of dispensing without any clogging of the vent valve. The materials used for the container and vented closure, according to the present invention, have a broad range of chemical compatibility and exhibit resistance to fluid attack that might otherwise create performance problems. In particular, the sealing and venting umbrella valve that is disclosed herein is fabricated from a silicone rubber (polymer) that includes a self-bleeding filler that bleeds to the surface over time and provides advantageous material properties.

Ultimately, the present invention provides a novel and unobvious advance in the state of the art.

SUMMARY OF THE INVENTION

A vented closure for closing and venting a container with threaded engagement to a neck portion of the container according to one embodiment of the present invention comprises a threaded cap that is constructed and arranged for threaded engagement to the container, the threaded cap defining a septum orifice, a gasket assembled into the threaded cap, an elastomeric venting valve assembled into the threaded cap, the venting valve including a septum with a slit therein, a retainer ring constructed and arranged to capture the venting valve and being attached to the threaded cap and a safety ring in unitary combination with the threaded cap for retaining the vented closure on the container.

One object of the present invention is to provide an improved vented closure.

Related objects and advantages of the present invention will be apparent from the following description.

DESCRIPTION OF THE PREFERRED EMBODIMENTS

Figure 1:
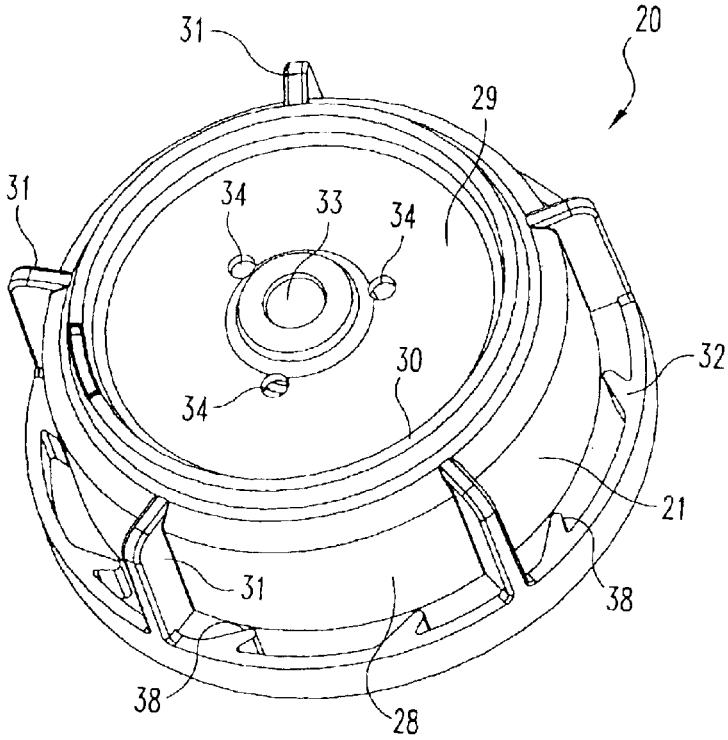
FIG. 1 is a perspective view of a vented closure according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
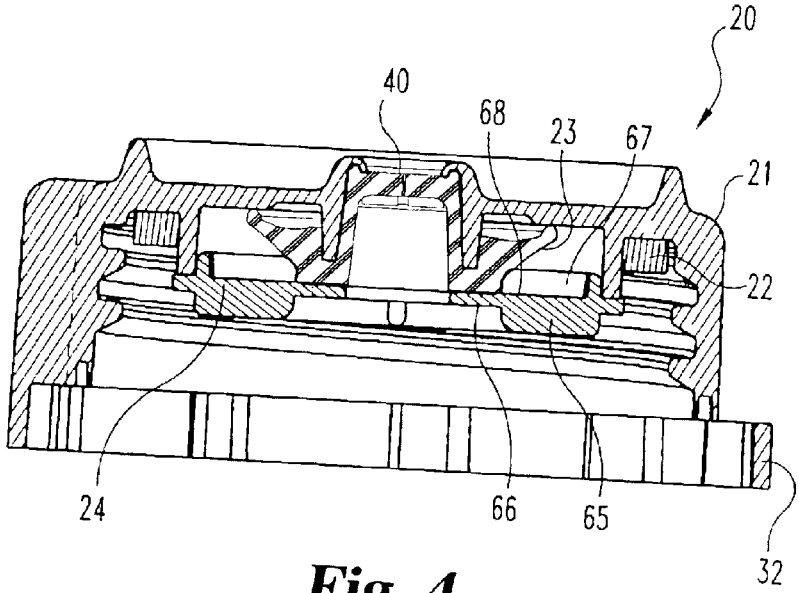
FIG. 4 is a front elevational view, in full section, of the FIG. 1 vented closure.
Figure 2:
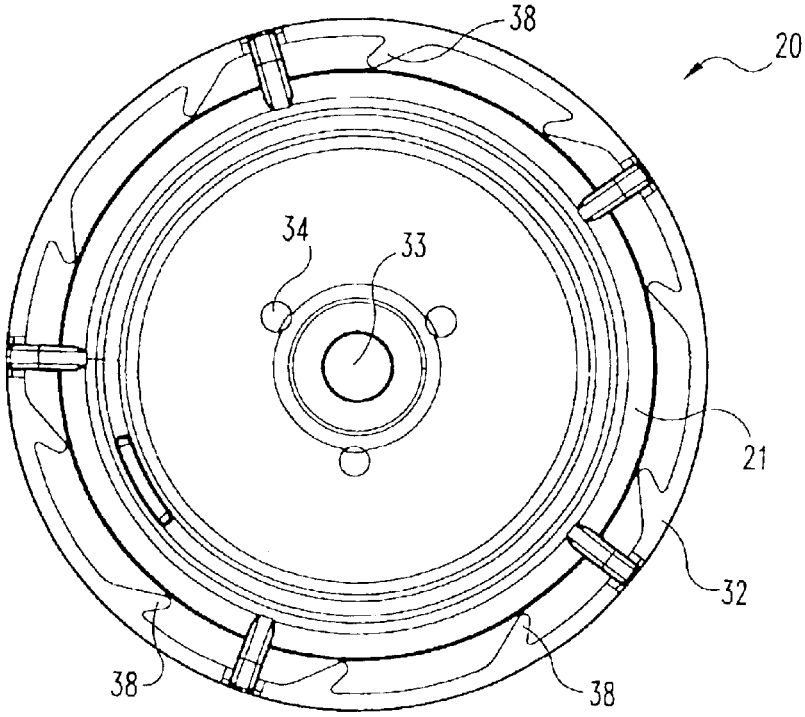
FIG. 2 is a top plan view of the FIG. 1 vented closure.
Figure 3:
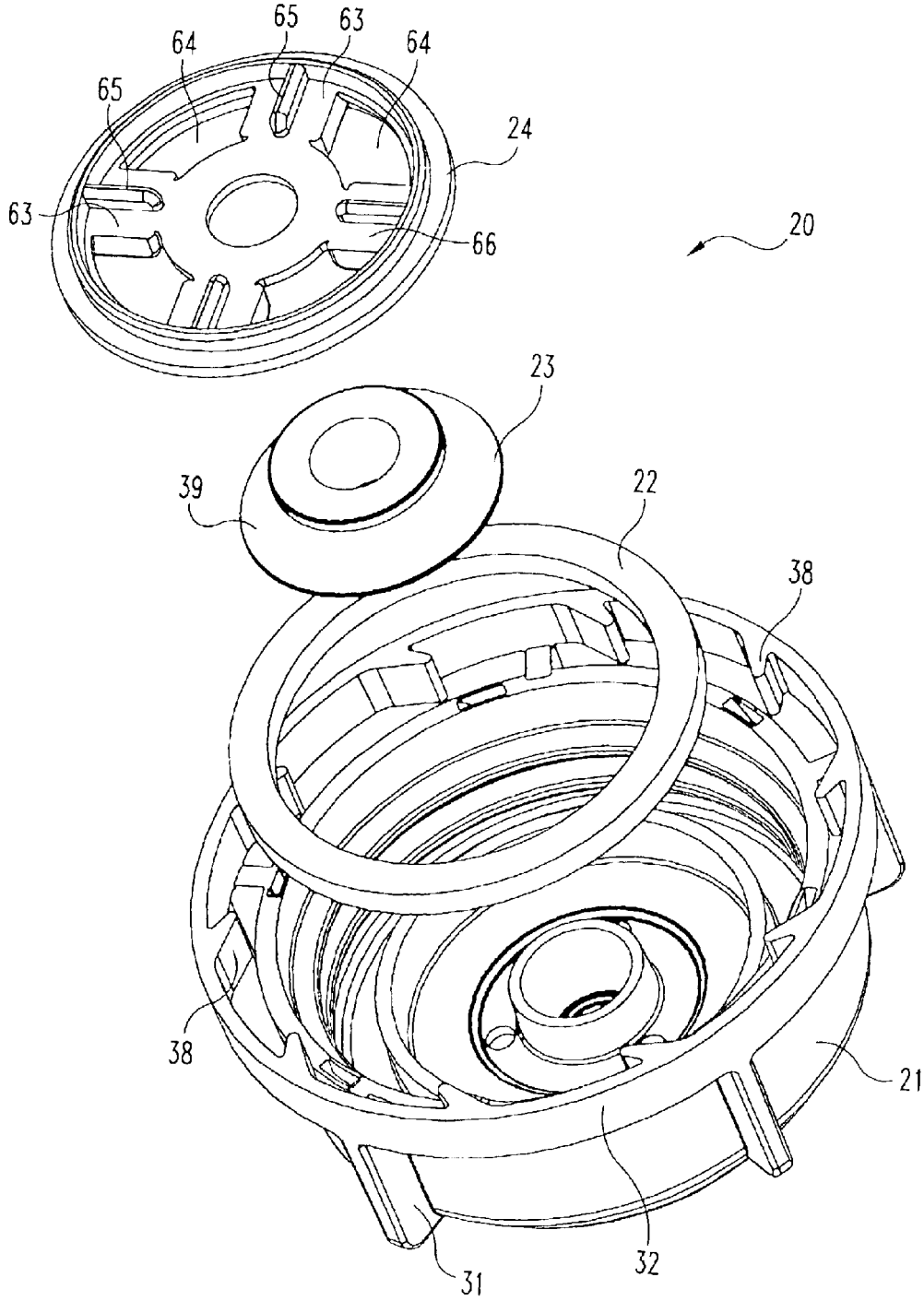
FIG. 3 is an exploded view, inverted, of the FIG. 1 vented closure.
Figure 6:
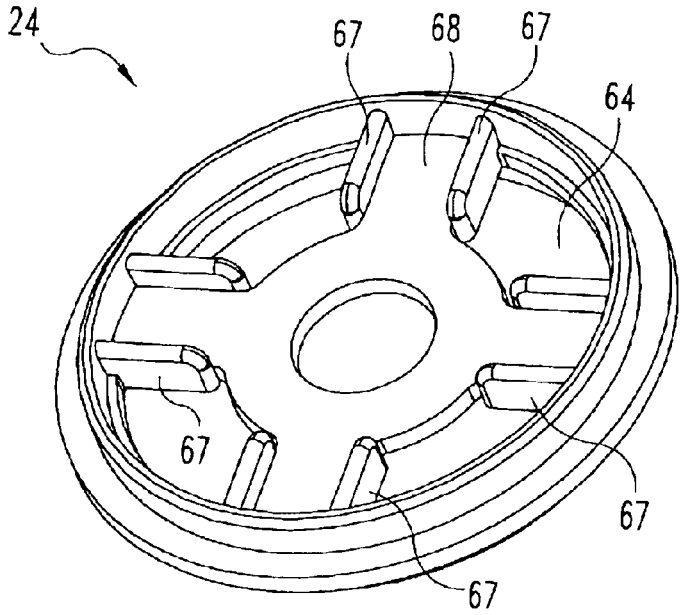
FIG. 6 is a perspective view of a retainer ring comprising one component of the FIG. 1 vented closure.
Figure 7:
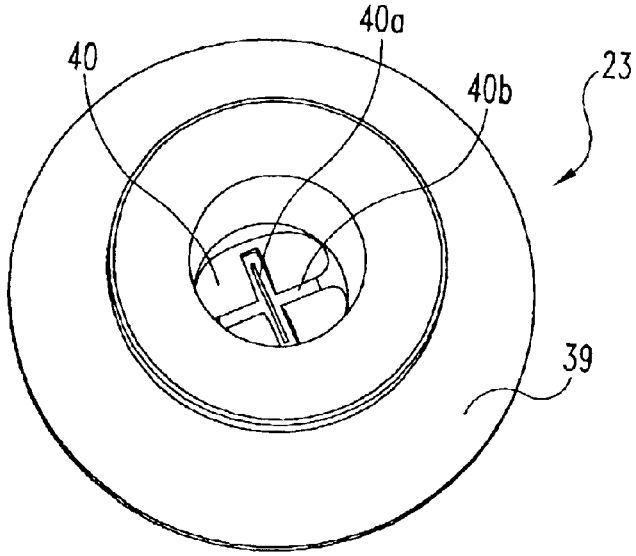
FIG. 7 is a perspective view of an umbrella valve comprising one component of the FIG. 1 vented closure.

Referring to FIGS. 1–4, there is illustrated a vented closure 20 according to a preferred embodiment of the present invention. Closure 20 is an assembly of four component parts, including cap 21, gasket 22, umbrella valve 23, and retainer ring 24. Each component part is annular in shape and substantially symmetrical about its longitudinal axis. The assembly of the four component parts, as illustrated in FIGS. 3 and 4, results in an assembly wherein all four component parts are substantially concentric to each other. The retainer ring 24 is additionally illustrated in FIG. 6. The umbrella valve 23 is additionally illustrated in FIG. 7.

Cap 21 includes an annular cap skirt 28, a top deck 29, a perimeter ring 30, five skirt ribs 31, safety ring 32, septum orifice 33, and three vent ports 34. Cap 21 is a unitary, molded plastic structure, with the preferred material being a high density polyethylene (HDPE).

The closure skirt 28 is internally threaded and the thread pitch corresponds to the thread pitch of the selected container (not illustrated) to which cap 21 is attached. The typical container for use with closure 20 includes an externally threaded neck portion that is compatible with the size, shape, and overall structure of cap 21. The top deck 29 is circular and substantially flat and is positioned radially inwardly of the perimeter ring 30. The five skirt ribs 31 are equally spaced and joined with the outer surface of cap skirt 28 along an inner surface of each rib 31. Each rib 31 is also joined with the upper surface of the safety ring 32 along a lower surface of each rib 31. The septum orifice 33 is sized to receive a piercing tubular conduit (siphon tube) for the dispensing of fluid from the container to a machine that is constructed and arranged to use the fluid as part of is intended function. An illustrative example of the "machine" for the present invention is a dishwashing machine and the "fluid" is a detergent.

The container is constructed and arranged and intended to be a scaled container once filled with the selected fluid and closed by the secure and tight threaded assembly of closure 21 onto the externally-threaded aperture or neck portion of the container. The safety ring 32 that is of unitary construction with cap 21 includes a circumferential series of equally-spaced ratchet teeth 38 that are designed to flex and ramp over one or more projections on the container as the closure is rotated in an advancing, clockwise direction. In the reverse or retrograde direction in an attempt to remove closure 20 from the container neck portion, the ratchet teeth 38 abut against the container projections, one or more, in order to prevent removal of the vented closure 20 in this reverse counterclockwise direction. In this way, the cap remains on the container once it is tightened into its full closing and sealing position. The safety ring 32 then serves as a tamper-proof structure to prevent removal of closure 20.

With a sealed container, as in the case of the present invention, as fluid is withdrawn, a negative pressure results in the interior of the container. If the negative pressure is not relieved, it can reach a level that would result in container paneling and/or container collapse. A high negative pressure on the interior of the container will also affect the dispensing of fluid from the container to the machine. Accordingly, the three vent ports 34 are provided for outside air to be able to enter the interior of the container in order to relieve or offset the negative pressure. If these three equally-spaced vent ports 34 are always open to the atmosphere, then the container is not "sealed" by the securement of closure 20 onto the container. This in turn would permit spillage during handling and transporting. To address this issue, an umbrella valve 23 is installed into cap 21 in order to close off each of the three vent ports 34 and provide a sealed interior to the container. The closed and sealed condition of umbrella valve 23 over vent ports 34 represents the static or at rest condition. However, as fluid is dispensed from the container, noting its closed and sealed condition, a negative pressure within the container begins to build. In order to use the vent ports 34 for introducing outside air into the container, the closing flap portion or outer radial ring of the umbrella valve 23 must be lifted off of the vent ports in order to enable the flow of outside air through those vent ports 34. This lifting or flexing of the umbrella valve flap occurs "automatically" once the internal negative pressure reaches a level sufficient to pull the radial valve flap away from the vent ports 34 by suction force. In order to provide for the flexing of the umbrella valve flap and thus the venting of the container, it becomes a matter of determining the appropriate material selection for the umbrella valve, determining the overall weight, size, and shape of the radial valve flap, as well as its flexibility so that it both provides the required sealing but can be lifted by the negative pressure in order to provide venting. It is also relevant consider the negative pressure level and the suction force that is created and at what negative pressure venting should occur. An additional discussion of the materials and material properties that are desirable for valve 23 is provided hereinafter.

With continued reference to FIGS. 3 and 4, umbrella valve 23 includes a substantially flat annular ring base 37, an annular, radial valve flap 39, and a septum (diaphragm) 40. Tapered sidewall 41 defines hollow interior 42 that is closed by septum 40. Radial valve flap 39 has a frustoconical shape that tapers in a radially outward direction to annular tip 43. Septum 40 includes a slit 40*a*, see FIG. 7, and reinforcing ribs 40*b*.

Cap 21 is a unitary, molded plastic component that includes an inner cylindrical wall 47 that is generally concentric with cap skirt 28, with perimeter ring 30, and with septum orifice 33. Septum orifice 33 is defined by tapered annular wall 48 that includes an annular receiving groove 49 and a substantially flat base surface 50. The annular wall 48 extends into an annular curved portion 46 that defines the septum orifice 33 and groove 49. This curved portion 46 has an inwardly tapering shape that receives and aligns a siphon tube with septum 40. The use of the siphon tube in order to dispense contents from the container will be described hereinafter.

While the inside surface 51 diverges from groove 49 in the direction of base surface 50, the outer surface 52 of wall 48 is also tapered such that it converges toward base surface 50. The tapered shape of wall 48 is constructed and arranged to match the tapered shape of groove 53 of valve 23. Groove 53 is of an annular form and is positioned between and defined by flap 39 and sidewall 41 (see FIG. 4). The cap 21 is preferably fabricated out of high density polyethylene (HDPE) and the illustrative size is 53 mm.

With continued reference to FIG. 4 and umbrella valve 23, the septum 40 is bounded by annular rib 54 and rib 54 fits into the annular receiving groove 49 and there is radial compression between the two at this annular location. The axially uppermost surface (curved portion 46) of wall 48 is rounded and is formed with an inner lip 59 that contacts septum 40. When umbrella valve 23 is assembled into cap 21, there is surface-to-surface abutment between the base surface 50 of wall 48 and groove 53 and between rib 54 and groove 49.

The complementing shapes and abutment between valve 23 and wall 48 cooperate to properly position and seat valve 23 in cap 21. This positioning also causes the outer annular tip 43 of valve 23 to extend radially beyond the outer edge of each vent port 34, one of which is illustrated in FIG. 4. As will be described, radial valve flap 39 is able to deflect away from the vent ports 34 when there is a sufficiently high negative pressure on the interior of the container so as to pull the radial valve flap 39 away from the inner surface 60 of top deck 29. This in turn breaks the sealed arrangement of flap 39 over and around vent ports 34 and allows outside air to flow through the vent ports 34 into the container in order to offset or relieve the negative pressure. The mass and resiliency or flexibility of flap 39 influences to a great extent the requisite negative pressure to be able to lift the flap 39 away from the vent ports 34.

Figure 5:
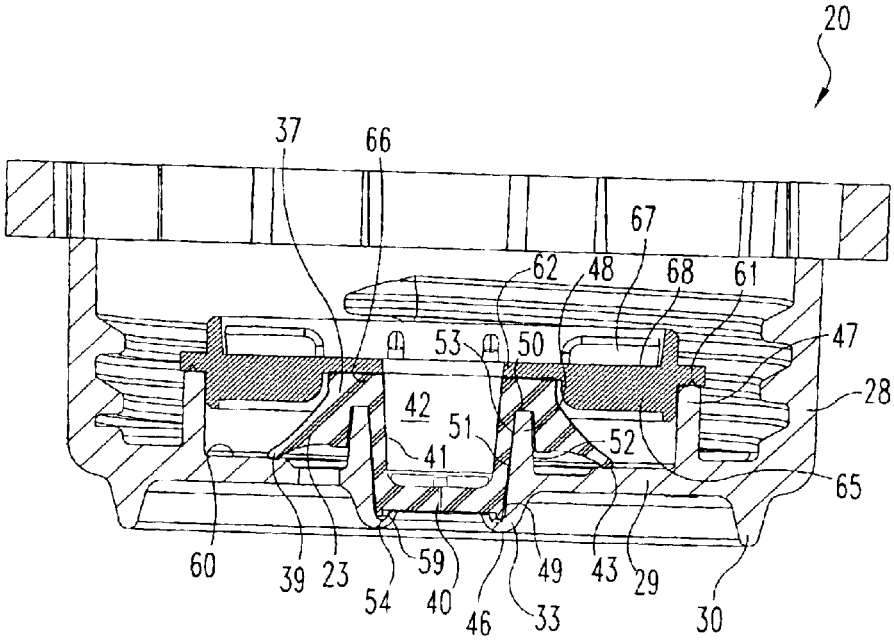
FIG. 5 is a front elevational view, in full section, of an alternative construction for the FIG. 1 vented closure.

In order to capture and retain the umbrella valve 23 in position and to ensure the proper or desired action of the radial flap 39, the retainer ring 24 is used. The outer annular lip 61 of retainer ring 24 is ultrasonically welded to the base of inner cylindrical wall 47. The inner radial lip 62 of retainer ring 24 is substantially flat and constructed and arranged to abut up against annular ring base 37. Retainer ring 24 can be used in the FIG. 3 orientation or flipped over. The FIG. 4 assembly corresponds to the FIG. 3 orientation. The FIG. 5 assembly corresponds to the "flipped over" orientation.

Retainer ring 24 has a wheel-like configuration including four equally-spaced spokes 63 with defined, sector-shaped open spaces 64 therebetween. Each spoke 63 includes a raised rib 65 on a first spoke surface 66 and a pair of raised ribs 67 on the opposite, second spoke surface 68. These ribs 65 and 66, four on one side and eight on the opposite side, add stiffening and rigidity to spokes 62. Molding considerations result in one rib 65 on one side 66 of each spoke and a pair of ribs 67, offset from the one rib 65, on the opposite side 68 of each spoke, see FIG. 6.

With regard to the assembly and capture of umbrella valve 23, there are two important locations in order to prevent fluid leakage and enable proper venting. First, the valve 23 is compressed axially by the abutment of retainer ring 24 up against base 37. This axial compression pushes flap 39 securely against the underside surface 60 of the cap top deck 29 outwardly of the vent ports. While the degree of axial compression is moderate, the shape of flap 39, the material choice, and its overall orientation facilitate this sealing task. There is also radial compression against sidewall 41 of valve 23 due to the fit of the tapered annular wall 48 against sidewall 41. Compression of the umbrella valve 23 between the tapered annular wall 48 and the retainer ring 24 maintains an optimum level of sealability and venting capacity, minimizing container paneling and container collapse. This location of radial compression can be limited to the compression of annular rib 54 into groove 49.

Once the vented closure 20 assembly is completed with the gasket 22 installed in cap 21, the umbrella valve 23 in position, and the retaining ring 24 ultrasonically welded to capture the umbrella valve 23, the vented closure 20 is ready for use on a container. The vented closure 20 is constructed and arranged to be threaded onto an externally threaded neck opening of the container. The surface of the container surrounding the neck opening includes at least one abutment projection for cooperation with the ratchet teeth 38 of safety ring 32. The vented closure 20 is able to be advanced and fully threaded onto the neck opening of the container until there is a tight and secured sealed connection. Any attempt to remove the vented closure 20 from the container causes the closest ratchet tooth 38 to abut up against the container projection, thereby preventing vented closure removal. With an equally-spaced series of ten ratchet teeth 38, the radial centerline-to-radial centerline spacing between adjacent teeth 38 is 36 degrees. With a pitch of approximately 5.25 threads per inch, there is very limited axial travel in the retrograde direction before a ratchet tooth 38 abuts up against the container projection. If a second projection is used and positioned 162 degrees from the first projection, the amount of axial travel permitted will be cut in half.

The anticipated container sizes are preferably 50 ounce, 64 ounce, and 90 ounce, but the present invention is not limited to only these three and the actual container size could be less than 50 ounces or more than 90 ounces and still remain consistent with the principles and teachings of the present invention. The preferred material for the container is a high density polyethylene (HDPE) with a 53 mm. neck size.

With the vented closure secured and sealed to the (filled) container, the process of dispensing the liquid (or slurry products) requires a connection to the machine or equipment that utilizes the liquid, such as a detergent for a dishwashing machine. This connection can be direct, as illustrated in FIG. 1 of the '950 patent, or indirect by way of a connecting conduit, as illustrated in FIG. 2 of the '950 patent. Regardless of the selected style of connection, a hollow, tubular penetrating device, also called a siphon tube, is inserted through the septum 40 of the umbrella valve 23. The curved portion 46 of cap wall 48, including lip 59, receives and aligns the penetrating device.

The umbrella valve 23 is a unitary member that is fabricated out of a silicone rubber, elastomeric material that has a slit 40*a* in septum 40. This slit 40*a* is self-sealing and prevents liquid within the container from escaping unless the sides of the slit are forced apart, such as by the use of the tubular penetrating device. Once the tubular penetrating device is inserted into (through) the slit 40*a* in the septum 40, the sides of the slit form a seal around the tubular penetrating device to prevent liquid leakage while the product within the container is being dispensed. The self-sealing of the sides of the slit around the siphon tube is facilitated in part by the choice of material for umbrella valve 23. Additionally, once (or if) the siphon tube is removed, the septum closes and returns to a self-sealing or self-sealed status. The reinforcing ribs 40*b* give more support and strength for improved resilience and closure of the slit 40*a* upon removal of the siphon tube.

In addition to providing a secure method of closing and scaling the vented closure 20 on the container, the safety ring 32 provides a tamper-proof structure such that the assembled vented closure 20 cannot be removed from the container without showing structural damage to either the safety ring 32 or the container projection. The safety ring 32 is securely attached to the cap skirt 28 by the five skirt ribs 31, all as part of a single unitary structure. Alternatively, though still part of a unitary construction, this type of connection can be replaced by a series of frangible elements as the sole means of connecting the safety ring 32 to the cap skirt 28 with the intent that upon forceful retrograde rotation of closure 20, these frangible elements will break, thereby allowing the closure to be removed from the container. When this is done and the frangible elements break, there will also be a clear visual indication of whether or not there has been any tampering attempt. The ability to remove the vented closure when intending to reuse the container allows the container to be refilled with a suitable liquid or slurried product and a new vented closure attached.

Since one of the critical components of vented closure 20 is the umbrella valve 23, it should be noted that special features are designed into umbrella valve 23 along with a custom formulated silicone material. This custom formulated silicone material allows the umbrella valve 23 to function in a uniquely different way than other valves employing other materials. Included as part of the diaphragm surface of umbrella valve 23 is a reinforcing rib configuration that is constructed and arranged to give more support and strength to umbrella valve 23 for improved resiliency and closure of the slit upon removal from the dispenser. In the context of the present invention, removal from the dispenser is intended to encompass removal of the siphon tube from the umbrella valve at which point the slit needs to close and provide a sealed surface.

The custom formulated silicone material, as used for umbrella valve 23, provides excellent material compatibility with various cosmetic components. This material exhibits good water resistance and stability when exposed to heat and ultraviolet rays. Additionally, the custom formulated silicone material for umbrella valve 23 has excellent non-stick properties, including good lubricating properties and improved resilience. Due to its low surface tension, this material is a good moisturizer.

Unlike organic polymer, silicone polymer by itself is relatively weak and produces tensile strengths of only 1.0 Mpa when crosslinked. To achieve useful engineering properties, it is necessary to reinforce the polymer by the addition of very fine, high surface fillers, which are compatible chemically with the silicone polymer. In addition, functional fluids called process aids are required for adequate shelf life control as well as processability, and curing agents are needed for vulcanization.

Precipitated silicas made through the acidification and precipitation of sodium silicate can also be used as reinforcing fillers in silicone compounds but usually give weaker mechanical properties compared to fumed silica. These components are, however, extremely good in terms of low compression set and high resilience, and are more cost effective than their fumed silica counterparts.

Because precipitated silica holds absorbed water on its surface, sponging may occur during curing unless pressure can be maintained on the part. For this reason, precipitated fillers are primarily utilized in compounds intended for the molding processes.

Process aids, also known as softeners, are reactive silicone fluids, which chemically modify the surface of the silica fillers to reduce their association with the silicone polymer. Most process aids are liquids, which can either be prereacted with the silica filler in a pretreatment process, or can be introduced during the compounding/mixing phase to effect "in-situ" treatment. In many cases, both techniques are employed.

Specially formulated into the silicone compound of the present invention as used for valve 23 is a self-bleeding filler at saturation levels to allow this fluid to bleed to the surface continually over time. This unique feature provides improved chemical resistance, adds lubrication to the surface of the slit 40*a* for easy insertion of the siphon tube, provides a non-stick surface while installed on the dispenser, and adds to the slit's resiliency to close the diaphragm quickly and seal any remaining chemical in the container upon removal.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A vented closure for closing and venting a container with threaded engagement to a neck portion of said container, said vented closure comprising:

a threaded cap constructed and arranged for threaded engagement to said container, said threaded cap defining a septum orifice and at least one vent;

a gasket assembled into said threaded cap;

an elastomeric venting valve assembled into said threaded cap, said venting valve including a septum with a slit therein;

a retaining ring constructed and arranged to capture said venting valve and being attached to said threaded cap; and a safety ring in unitary combination with said threaded cap for retaining said vented closure on said container.

2. The vented closure of claim 1 wherein said elastomeric venting valve is fabricated from a silicone polymer formulated with a self-bleeding filler.

3. A venting closure for securing to a threaded opening of a holding container for a flowable material comprising:

a threaded cap constructed and arranged to be coupled to the threaded opening of said container, the threaded cap defining a septum orifice and at least one vent;

an umbrella valve assembled inside of the threaded cap, said umbrella valve including a septum defining a slit, said umbrella valve being constructed and arranged for sealing said at least one vent at a first container internal pressure and opening said at least one vent a second container internal pressure; and a retaining ring secured to said threaded cap over said umbrella valve, said retaining ring including a plurality of spokes.

4. The venting closure of claim 3 wherein the threaded cap includes a safety ring of unitary construction and wherein the safety ring is constructed and arranged for preventing removal of the cap after attachment.

5. The venting closure of claim 4 wherein the safety ring is unitarily formed with the threaded cap using a plurality of skirt ribs.

6. The venting closure of claim 4 wherein the container includes a plurality of projections.

7. The venting closure of claim 4 wherein the safety ring includes a plurality of ratchet teeth.

8. The venting closure of claim 3 wherein the spokes of the retaining ring include a top surface and a bottom surface, the spokes further including one rib on said top surface and two ribs on said bottom surface.

9. The venting closure of claim 3 wherein the retaining ring is secured by ultrasonic welding.

10. The venting closure of claim 3 wherein the umbrella valve has tapered edges.

11. The venting closure of claim 3 further including a gasket assembled inside of the threaded cap under said umbrella valve.

12. The venting closure of claim 3 wherein the umbrella valve is composed of a silicone polymer formulated with a self-bleeding filler.

13. The venting closure of claim 3 wherein the threaded cap is composed of a high density polyethylene.

14. A method to enable fluid inside a container to flow without creating a negative internal pressure comprising:

(a) attaching a closure to a fluid holding container, said closure comprising:

a threaded cap including a safety ring formed therewith, said threaded cap defining a septum orifice and at least one vent;

an umbrella valve defining a slit assembled inside said threaded cap; and a retaining ring sealed to said threaded cap over said umbrella valve;

(b) inserting a conduit through the septum orifice and the slit into said container; and (c) draining fluid through the conduit, wherein air passes through the at least one vent into the container when the umbrella valve actuates in response to a build up of negative internal pressure inside the container.

15. A venting closure apparatus comprising:

a container for holding a flowable material including a threaded opening;

a threaded cap coupled to the threaded opening, said threaded cap including a top deck defining a septum orifice and at least one vent therein, said threaded cap further including a safety ring unitarily formed therewith;

a gasket assembled inside of said threaded cap;

an umbrella valve assembled inside the threaded cap overtop the gasket, said umbrella valve including a septum defining a slit therein, wherein the umbrella valve is constructed and arranged to close at a first container interior pressure and open at a second container interior pressure;

a retaining ring secured over the umbrella valve inside the threaded cap, said retaining ring including a plurality of spokes; and a tubular conduit inserted through the septum orifice and the umbrella valve slit into said container.

16. The venting closure apparatus of claim 15 wherein the retaining ring is secured using ultrasonic welding.

17. The venting closure apparatus of claim 15 wherein the umbrella valve is composed of a silicone polymer.

18. The venting closure apparatus of claim 17 wherein the silicone polymer is formulated using a self-bleeding filler.

* * * * *

UNITED STATES PATENT AND TRADEMARK OFFICE

CERTIFICATE OF CORRECTION

PATENT NO. : 6,874,656 B2
DATED : April 5, 2005
INVENTOR(S) : Rohr et al.

It is certified that error appears in the above-identified patent and that said Letters Patent is hereby corrected as shown below:

Column 3,
Line 52, replace “scaled” with -- sealed --.

Column 6,
Line 62, replace “scaling” with -- sealing --.

Signed and Sealed this

Twentieth Day of December, 2005

JON W. DUDAS
*Director of the United States Patent and Trademark Office*